US006824134B2

(12) United States Patent
Abe et al.

(10) Patent No.: US 6,824,134 B2
(45) Date of Patent: Nov. 30, 2004

(54) AUTOMATIC ADJUSTING DEVICE FOR A BANK NOTE HOLDING MEMBER

(75) Inventors: Hiroshi Abe, Iwatsuki (JP); Joji Iida, Hachiouji (JP)

(73) Assignee: Asahi Seiko Co., Ltd., Tokyo (JP)

( * ) Notice: Subject to any disclaimer, the term of this patent is extended or adjusted under 35 U.S.C. 154(b) by 80 days.

(21) Appl. No.: 10/271,042

(22) Filed: Oct. 15, 2002

(65) Prior Publication Data

US 2003/0085510 A1 May 8, 2003

(30) Foreign Application Priority Data

Oct. 16, 2001 (JP) ..... 2001-318228

(51) Int. Cl.[7] ..... B65H 1/00
(52) U.S. Cl. ..... 271/171; 271/241; 109/47
(58) Field of Search ..... 271/171, 157, 271/241, 223; 109/45, 47

(56) References Cited

U.S. PATENT DOCUMENTS 4,030,725 A * 6/1977 Fukui et al. ..... 271/164
4,358,102 A * 11/1982 Hoshizaki et al. ..... 271/164
4,597,340 A * 7/1986 Huckle ..... 109/45
4,638,746 A * 1/1987 Ishigure ..... 109/52
4,728,096 A 3/1988 Winkler et al.
4,755,011 A * 7/1988 Seroka et al. ..... 312/312
4,840,368 A * 6/1989 Uehara ..... 271/162
5,188,351 A * 2/1993 Gysling ..... 271/171
5,292,116 A * 3/1994 Inoue et al. ..... 271/157
5,927,707 A * 7/1999 Miura ..... 271/171

* cited by examiner

*Primary Examiner*—Donald P. Walsh
*Assistant Examiner*—Matthew J Kohner

(57) ABSTRACT

An automatic adjusting device for a bank note holding member is provided. The bank note holding member can be inserted into a safe for the dispensing of bank notes. The holding member can have relatively movable side and end walls which can automatically and mechanically adjust to the particular size of the stack of bank notes that are inserted therein. When the bank note holding member is removed, the walls can be automatically extended to open the space to receive bank notes. When the bank note holding member is inserted into a safe, the respective walls can close on the stack of bank notes and assert a predetermined force to align the bank notes stored therein.

5 Claims, 7 Drawing Sheets

AUTOMATIC ADJUSTING DEVICE FOR A BANK NOTE HOLDING MEMBER

BACKGROUND OF THE INVENTION

1. Field of the Invention

This invention relates to a bank note storing device which can be used in a vending machine or a moneychanger, and more particularly, relates to an automatic adjusting-device for a bank note holding frame which can automatically adjust the position of the holder frame to accommodate different size bank notes.

2. Description of Related Art

"Bank note" as used in this specification embraces a check, a certificate, coupon ticket or exchange ticket like a bank note. It also can be any stack of rectangular sheets.

A small bank note storing device that includes a bank note holder which encloses bank notes and has a holder frame is known. The position of the holder frame can be adjusted to the size of a bank note. The adjusting work is carried out manually by an operator or a holder is used having a holder frame which is fixed for a particular size of the bank note. Therefore, the adjusting work can be a tedious ordeal. Also, when the fixed holder frame is used, there are many different kinds of fixed holders. Therefore, the required storage space becomes large.

Thus, the prior art is still seeking an improved adjusting bank note holding frame with an automatic capability.

SUMMARY OF THE INVENTION

A purpose of this invention is to provide an automatically adjustable bank note holder to adapt to different sizes of bank notes.

An automatic adjusting device for a bank note holding frame comprises a width holder frame, which can be moved to accommodate the width of a bank note in the bank note holder, a link device, which is operatively linked to the width holder frame, and an operating device which is located at one side of the bank note storing device and is operatively linked to the link device.

In this structure, bank notes are put into the bank note holder which is enclosed by the holder frame. Afterwards, the bank note holder is moved into the bank note storing device. During the moving process, the link device is located at the side of the holder frame and is operatively linked to the operating device which is attached in the bank note storing device. Therefore, the width holder frame can be moved to accommodate the width of a bank note, and to push the bank notes together.

As a result, the bank notes are automatically arrayed to the position of the width of the bank notes. Also, when different bank notes with different widths are placed into the bank note holder, the width position of the bank notes is automatically changed to adapt to the different bank note. Therefore, the operative position of the holder frame is automatically adjusted.

The present invention permits the automatic adjustment of the width of the holder frame to reduce the overall size of the bank note holder. A width holder holds the width holder frame at a position that is wider than the bank note width, while a releasing device releases the width holder. When the bank note holder is moved into the bank note storing device, it has contact with the width holder, a link device which is operatively linked to the width holder frame, and an operating device which is located at the side of bank note storing device, and is operatively linked to the link device to adjust the width.

In this structure, bank notes are put into the bank note holder which is enclosed by the holder frame. Afterwards, the bank note holder is moved into the bank note storing device. In the moving process, the releasing device releases the width holder. Therefore the width holder frame is urged towards the width direction of the bank notes and is moved in the same direction. As a result, the bank notes are arrayed by the width holder frame primary in the width direction.

Next, the bank note holder goes into the bank note storing device. In this situation, the link device is attached at the bank note holder and is operatively linked to the operating device. Therefore, the width holder frame moves in the width direction through the link device and pushes the bank notes.

As a result, the bank notes in the bank note holder are automatically arrayed. At the first arraying, the bank notes initial volume is reduced and the bank notes are arrayed together. In a second process, the bank notes are pushed together even closer. Therefore, the bank notes are arrayed in a tight stack. Finally, if the size of the bank notes are changed, the position of the holder frame is automatically changed.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENT

The following description is provided to enable any person skilled in the art to make and user the invention and sets forth the best modes contemplated by the inventors of carrying out their invention. Various modifications, however, will remain readily apparent to those skilled in the art, since the general principles of the present invention have been defined herein specifically to provide an automatic bank note adjusting device for aligning the position of bank notes.

Figure 1:
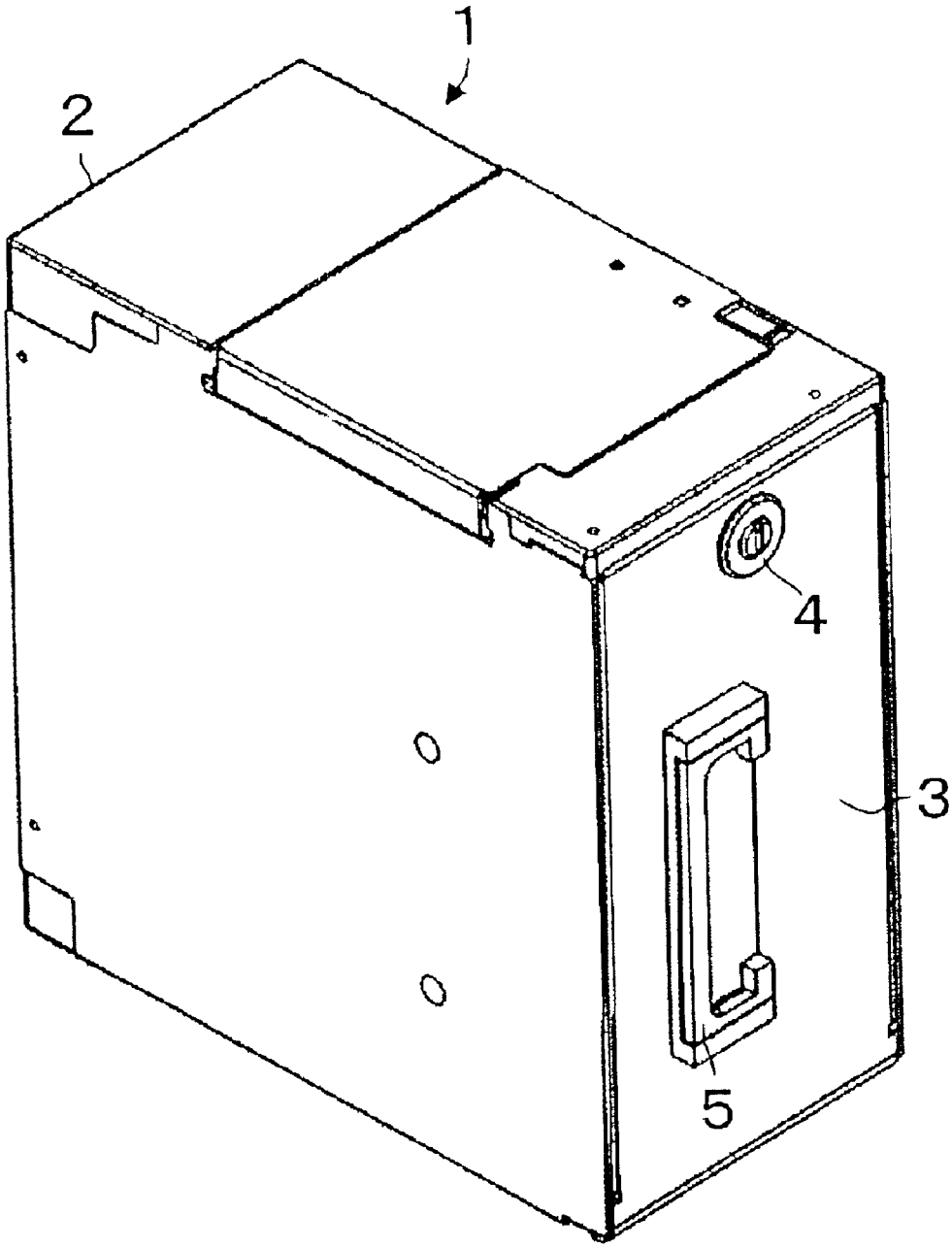
FIG. 1 is a perspective view of the bank note storing device of the present invention.

Firstly, bank note storing device 1 is explained (as shown in FIG. 1). Bank note storing device 1 has a case 2 which is box-like in shape and a lid 3 which is hinged at a lower section of the case 2. The bank note storing device 1 can be closed or opened by lid 3. A lock member 4 is provided at the upper section of lid 3. Therefore, lid 3 can be locked on case 2.

Figure 2:
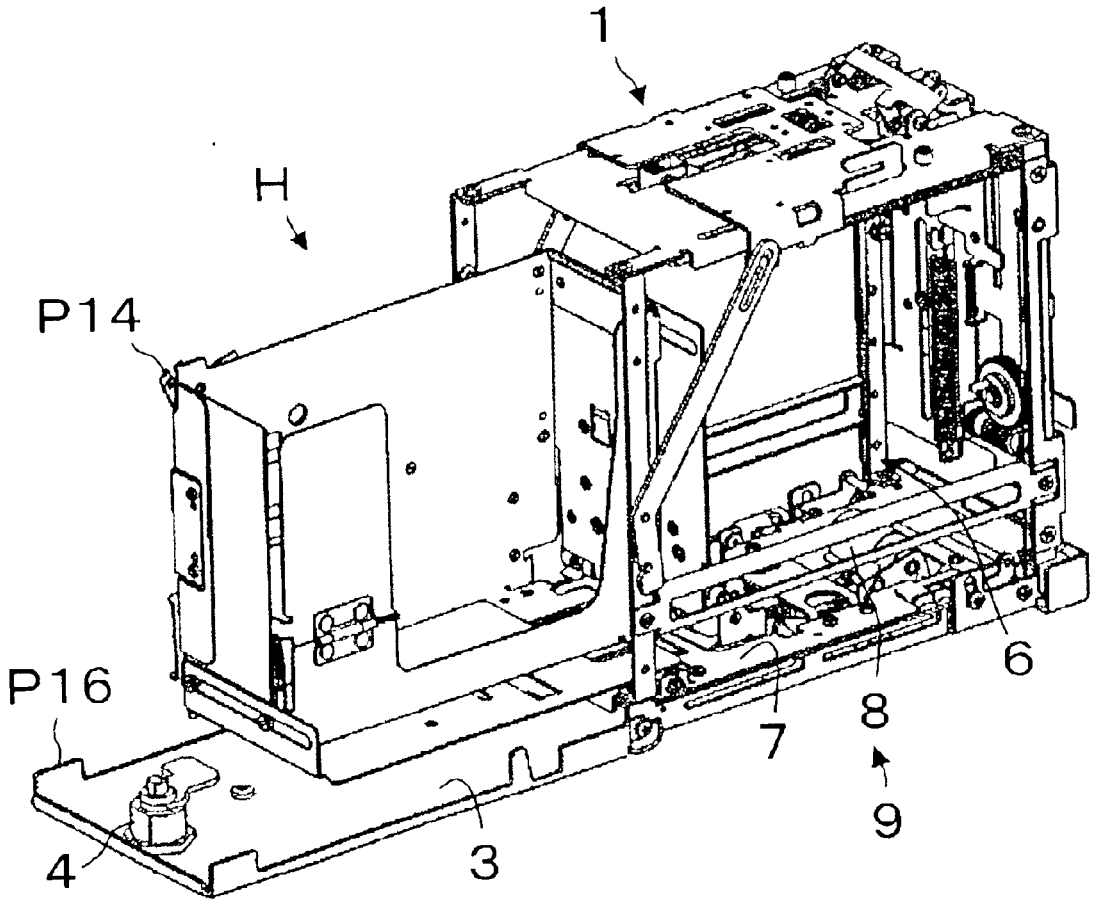
FIG. 2 is a perspective view of the bank note storing device without an outer cover and with the bank note holder drawn out.

Handle 5 is gate like in shape and is fixed on lid 3. Therefore, the bank note storing device 1 can be transported by an operator. The storing section 6 of the bank note storing device 1 (shown in FIG. 2) is defined by a separating board 7. A bank note transporting device 9 is attached at separating board 7 and has driving rollers 8 for transporting the lower most bank note for dispensing.

Figure 4:
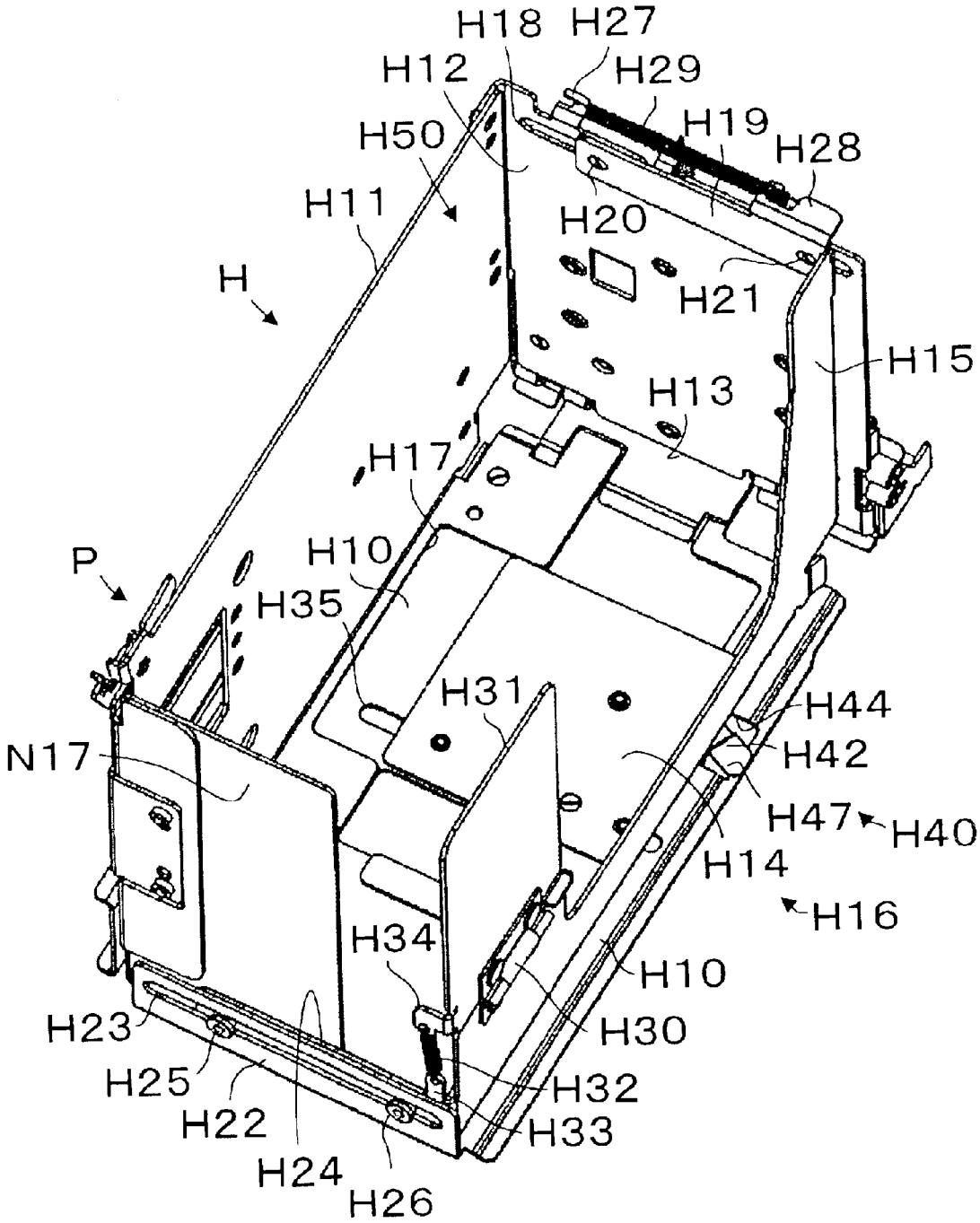
FIG. 4 is a front elevation perspective view of the bank note storing device.

Next bank note holder H is explained (as shown in FIG. 4). Right side board H11 and front side board H12 are fixed at base H10 to extend vertically upward. Bank note exit H13 is rectangular in shape and is located at the lower section of front side board H12. Width holder frame H16 includes a horizontal board H14 which is rectangular and a vertical board H15 which is L-shaped.

Horizontal board H14 is inserted into a concave space H17 which is channel like in shape and permits board H14 to be slidable. Elongated hole H35 extends across the width of the bank notes and is located at base H10. Guiding rollers H36 and H37 are attached at the rear of horizontal board H14 (shown in FIG. 5).

Guiding rollers H36 and H37 are inserted into elongate hole H35 and are slidable therein. Elongated hole H18 extends horizontally and is located at the upper section of front side board H12. Bar H19 also extends horizontally along the front side board H12 from the upper section of vertical board H15. Guiding rollers H20 and H21 are attached at bar H19 and are slidably inserted into the elongated hole H18 to permit adjustment of the position of the side vertical board H15.

Elongated hole H23 also extends horizontally and is located at the lower portion of rear wall H22 which, in turn, is vertical to the base 10. Bar H24 extends horizontally along rear wall H22 from the rear section of vertical board H15. Guiding rollers H25 and H26 are attached at bar H24 and they are slidably inserted into elongated hole H23 to further support the adjustment of vertical board H15. Width holder frame H16 is guided by the respective elongated holes H18, H23 and H35, and they can be moved closer or further away from the right side board H11.

In other words, width holder frame H16 can move laterally. Projection H27 extends horizontally and is located at the upper section of front side board H12. Projection H28 extends horizontally and is located at the upper section of bar H19. Spring H29 is hooked between the projections H27 and H28. Therefore, width holder frame H16 is urged towards the right side board H11 by spring H29.

Swing board H31 is attached at the upper section of the side of rear wall H22 by a hinge H30. Swing board H31 is biased to pivot towards the side of right side board H11 by spring H32. When swing board H31 pivots towards the side of right side board H11, swing board H31 is stopped by the upper section of vertical board H15 and is kept vertical.

Spring H32 is hooked between projection H33 of bar H24 and projection H34 which extends towards the side of right side board H11. When swing board H31 pivots towards the side of right side board H11 more than a predetermined angle, swing board H31 will be forced to pivot in the clockwise direction by a snap-action-mechanism (shown in FIG. 4).

Figure 5:
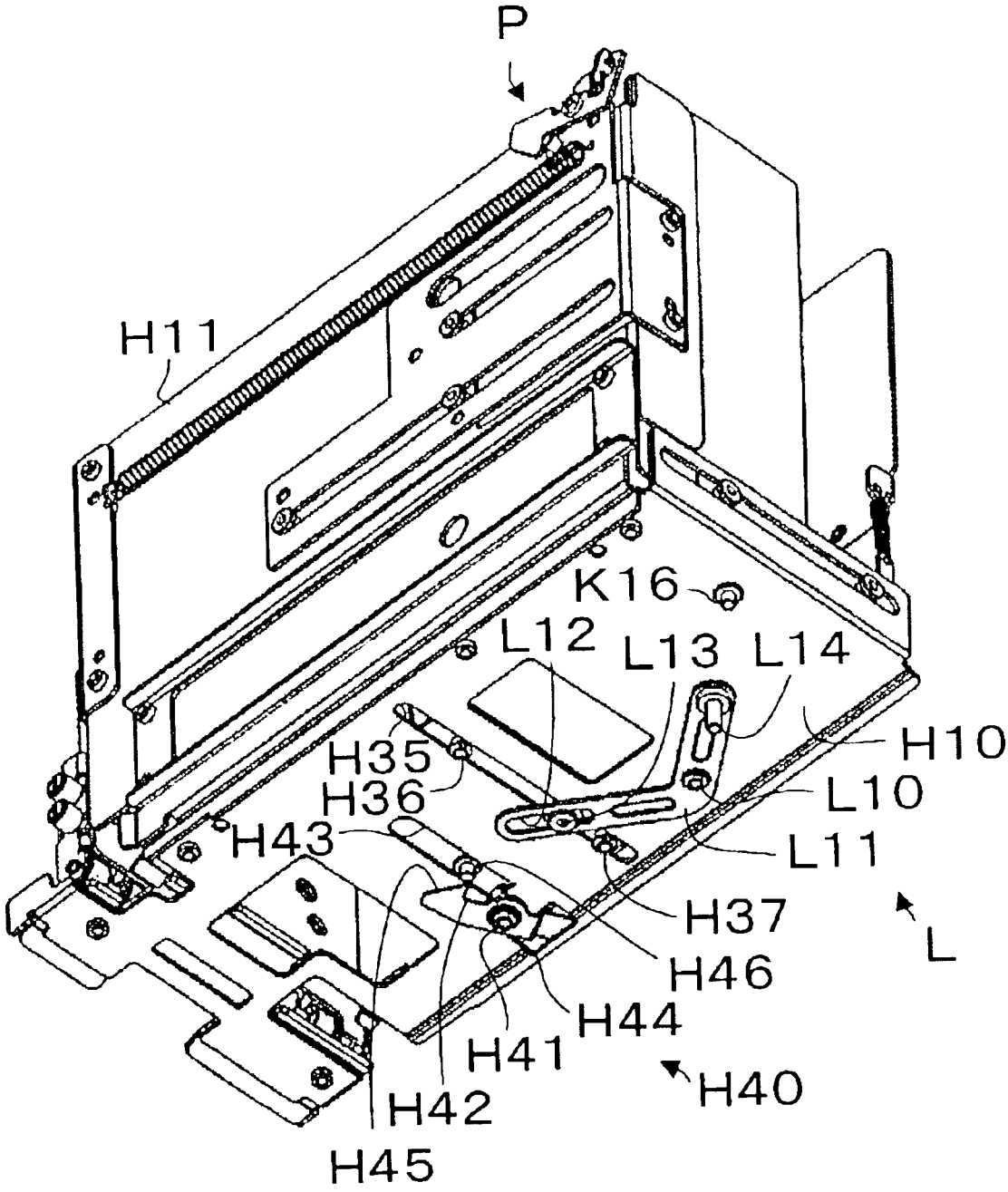
FIG. 5 is a bottom perspective view of the bank note storing device.

Next width holder H40 is explained (as shown in FIG. 5). Hook H42 can swing about fixed shaft H41 which protrudes downwards from the rear of base 10. Hook H42 is biased to pivot in the clockwise direction by a spring (not shown). As shown in FIG. 5, hook H42 has an indented portion stopped by the end of the opening H44 of base H10.

Slanting surface H45 is the end portion of hook H42. When hook H42 is stopped by the end of opening H44, the hook H42 is located opposite the elongated hole H43. Pin H46 is fixed at the rear of horizontal board H14 and is inserted into elongated hole H43 which extends in the same direction as elongated hole H35 and is slidable relative to the elongated hole H43.

Figure 3:
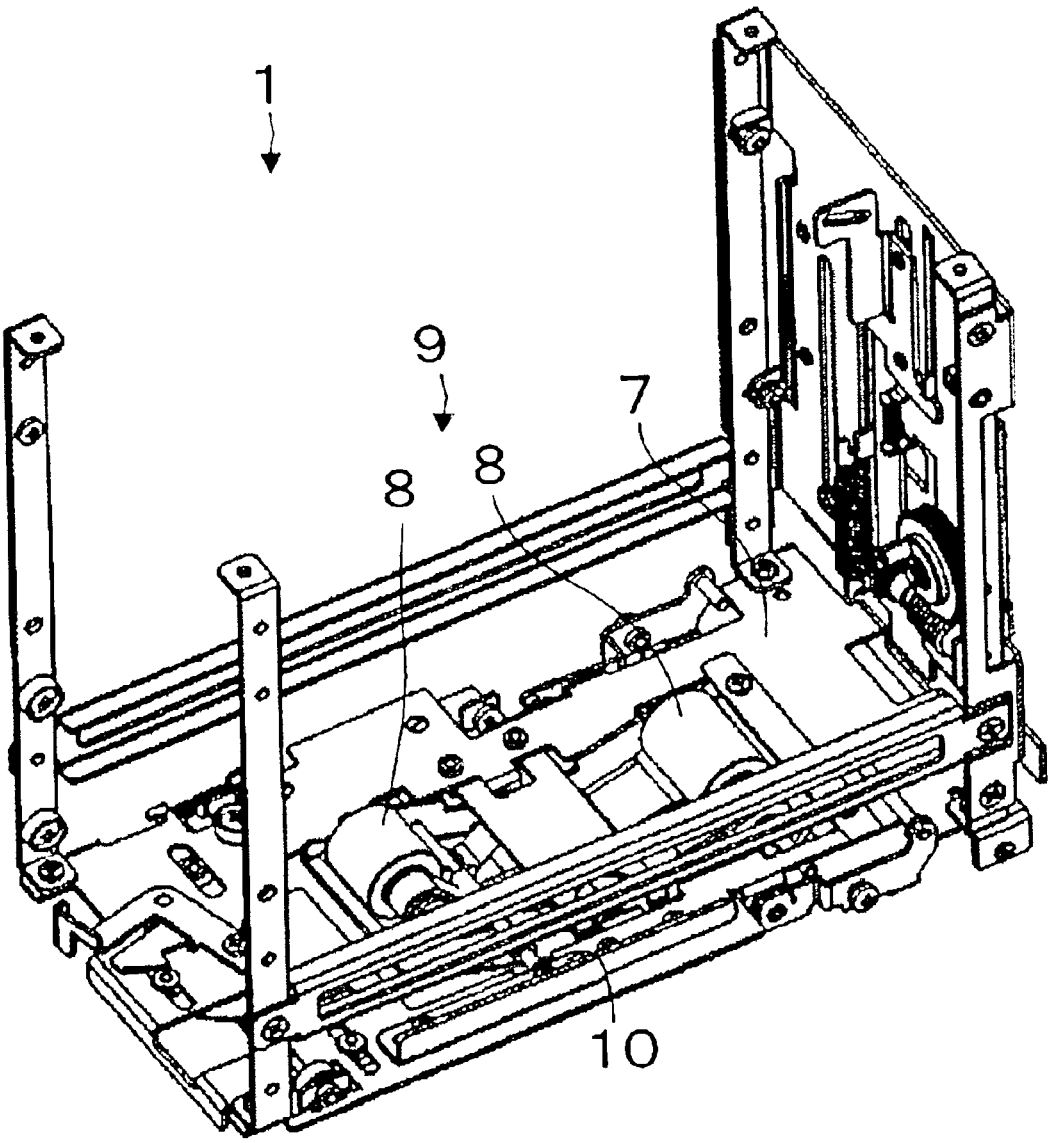
FIG. 3 is a perspective view of the bank note storing device without an outer cover.

When pin H46 is moved towards the side of hook H42, it pushes the slanting surface H45. Therefore hook H42 pivots in the counterclockwise direction and pin H46 is hooked by hook H42. Pusher 10 (shown in FIG. 3) of the bank note storing device 1 can push end H42 of hook H47 (shown in FIG. 4). When pusher 10 pushes end H47, hook H42 releases pin H46. Pusher 10 acts as the releasing device.

Next, link device L is explained with reference to FIG. 5. Lever L11 is boomerang-like in shape and can pivot on fixed shaft L10 which is fixed at the rear of base H10. Pin L13 is fixed at the rear of horizontal board H14 and is inserted into elongated hole L12. Pin L14 is fixed downwards at one end of lever L11.

Figure 6:
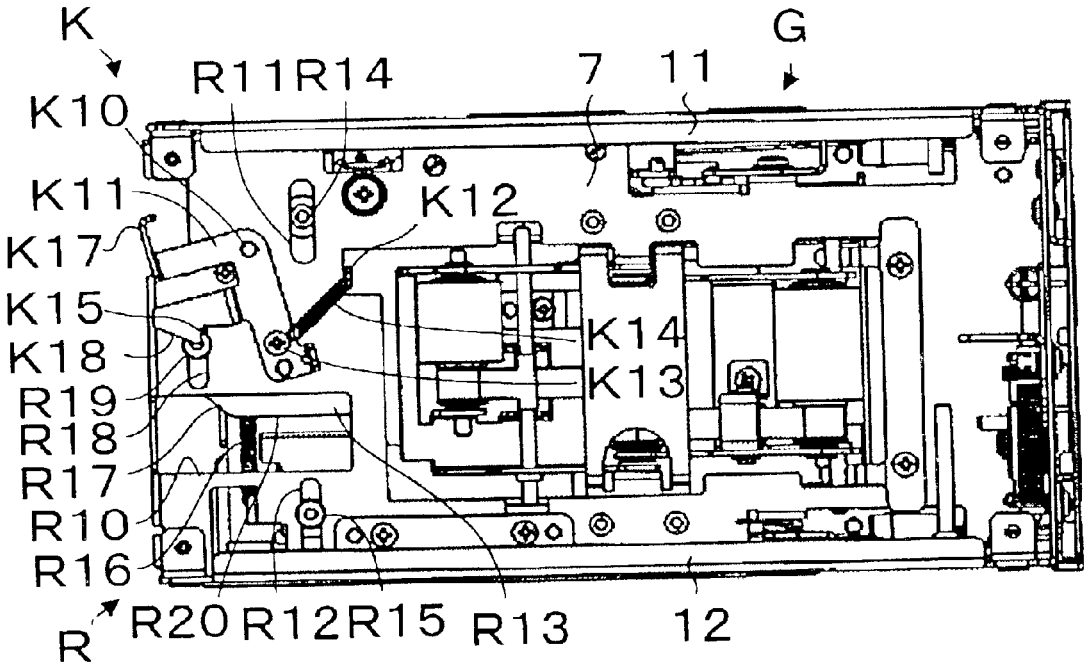
FIG. 6 is a plane view of the bank note storing device without the outer cover.
Figure 7:
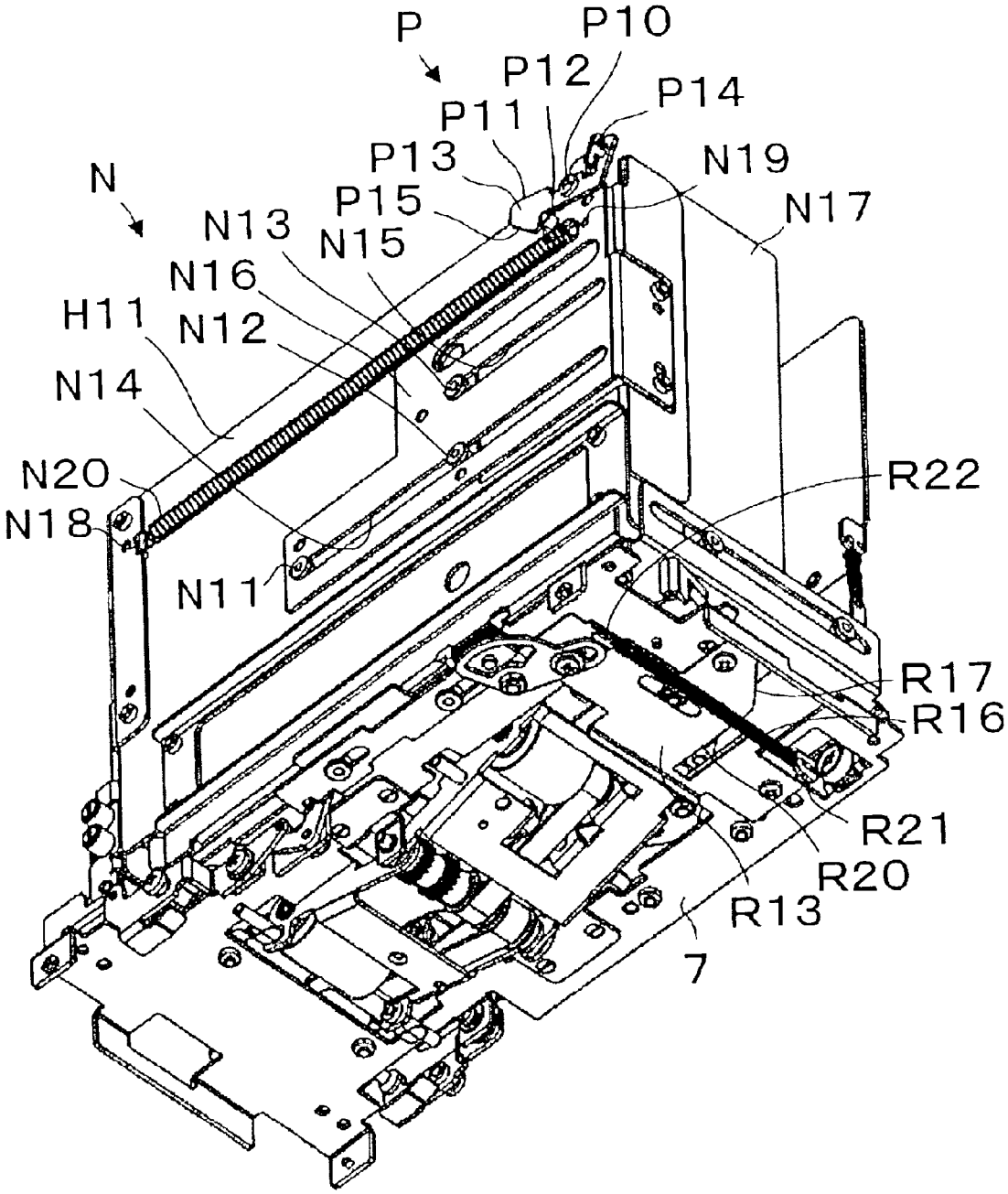
FIG. 7 is a bottom perspective view of the bank note storing device without the outer cover.

Next, operating device R is explained (as shown in FIGS. 6 and 7). Concave space R10 is rectangle and is located both in the front side board H12 and extends inward from the rear edge of separating board 7. Elongated holes R11, R12 and R18 extend horizontally in the width direction and are located at separating hoard 7. Cam board R13 is located at the rear of separating board 7. Pins R14, R15 and R19 are fixed on cam board R13 and are inserted separately in elongated holes R11, R12 and R18 and are slidable therein.

Cam board R13 is urged towards vertical board H15 by spring R16 (shown in FIG. 6). Spring R16 is hooked between projection R21 which is fixed at the rear of separating board 7 and projection R22 of cam board R13. Slanting cam R17 is located at the side on the rear of cam board R13. Straight section R20 continues longitudinally to slanting cam R17.

When bank note holder H is moved into storing section 6, pin L14 pushes slanting cam R17. Therefore, lever L11 pivots in the clockwise direction as shown in FIG. 5. As a result, horizontal board H14 moves towards the side of right side board H11 through contact with pin L13. Vertical board H15 moves in the same direction together with horizontal board H14.

When the moving resistance of vertical board H15 increases, spring R16 is extended and pin L14 has contact with the straight section R20. Therefore, vertical board H15 keeps its position.

Next, longitudinal holding device N is explained (as shown in FIG. 7). A pair of rollers N11 and N12 are attached at right side board H11 and are located parallel to the separating board 7. Roller N13 is located above roller N12. Elongated holes N14 and N15 are located to extend parallel in sliding board N16.

Rollers N11 and N12 are inserted into elongated hole N14, and roller N13 is inserted into elongated hole N15. Therefore, sliding board N16 can move towards the longitudinal direction of the bank notes and along the right side board H11. Longitudinal holding frame N17 is fixed opposite to the front side board H12 at sliding board N16.

Spring N20 is hooked between projection N18 of front side board H12 and hole N19 of sliding board N16. Therefore, longitudinal holding frame N17 is urged to move towards the side of front side board H12 by spring N20.

Next, holding device P of longitudinal holding device N is explained (as shown in FIG. 7). Lever P11 can pivot on fixed shaft P10 which extends horizontally towards the rear upper section of right side board H11. Hook P13 of lever P11 can hook the projection P12 of sliding board N16.

Slanting surface P15 is located at the side of front side board H12 at lever P11 and can have contact with projection P12. Projection P14 extends horizontal towards the other end of lever P11 and is located opposite to projection P16 of lid 3.

Bank note storing section H50 includes a front side board H12, a longitudinal holding frame N17, a right side board H11 and a vertical board H15. Bank note holder H locates the longitudinal position of a bank note by front side board H12 and longitudinal holding frame N17 and locates the width position of a bank note by right side board H11 and vertical board H15.

Next, guiding device G of bank note holder H is explained (as shown in FIG. 6). Guiding device G is guide rails 11 and 12 which both have an L shape. The upper surfaces of guide rails 11 and 12 guide the left and right edges of base H10. Therefore, bank note holder H can go into and out of the storing section 6. Guide rails 11 and 12 are fixed at the left and right edges adjacent separating board 7 (the upper and lower edges shown in FIG. 6).

Next rocking device K of bank note holder H is explained (as shown in FIG. 6). Lever K11 is F-like in shape and can pivot on fixed shaft K10 which is located at the upper surface of separating board 7. Lever K11 is biased to pivot in the counterclockwise direction by a spring K14 which is hooked between projection K12 and K13.

Hook K15 is integrally formed on lever K11. Hook K15 can hook to pin K16 (see FIG. 5) which is located at the rear of base H10. When operator member K17 is pushed, lever K11 pivots in the clockwise direction. Therefore, hook K15 disengages from pin K16. Slanting surface K18 is located at lever K11 and can be engaged with pin K16.

Next, an operation of this embodiment of the invention is explained. Firstly, the bank notes are supplied for storage. Lock 4 is unlocked and afterwards lid 3 is opened. Operator K17 is pushed towards the front side board H12. Therefore, lever K11 pivots in the clockwise direction shown in FIG. 6 and hook K15 disengages from pin K16 on base H10.

Next, rear wall H22 is drawn out from the storing section 6. At this process, pin L14 disengages from the cam board R13. Therefore, width holder frame H16 is moved towards the right side board H11 by the force from spring H29.

When there are no bank notes in the storing section, the end of right side board H11 is stopped by the end of concave space H17. Therefore, width holder frame H16 is stopped. Longitudinal holding frame N17 is moved towards the side of the front side board H12 by spring N20 from the sliding board N16 and is stopped by the guide rollers N12 and N13.

Next, width holder frame H16 and longitudinal holding frame N17 are moved to permit the bank notes to be put into storing section 6 easily. In other words, vertical board H15 is moved opposite to vertical board H11. At this process, pin H46 pushes slanting surface H45 of hook H42. Therefore, hook H42 pivots in the counterclockwise direction. When slanting surface H45 disengages from pin N46, hook H42 pivots in the clockwise direction by a spring (not shown). As a result, hook H42 hooks pin H46.

Therefore, width holder frame H16 is held at an extended position from right side board H11 by width holder H40. Next, longitudinal holding frame N17 is moved in the opposite direction to front side board H12. During this process, pin P12 pushes slanting surface P15. Therefore lever P11 pivots in the clockwise direction (as shown in FIG. 7).

When pin P12 passes through the slanting surface P15, lever P11 is pivoted in the counterclockwise direction by a spring (not shown). Therefore, hook P13 hooks pin P12. As a result, longitudinal holding frame N17 is kept further away from front side board H12.

Next, the bank notes are inserted into bank note storing section H50 by a user. When the bank notes are put into bank note storing section H50, swing board H31 can pivot in the clockwise direction away from vertical wall H11 to make the insertion operation easy to accomplish.

Lever P11 is pivoted in the clockwise direction by an operator. Therefore, hook P13 unhooks projection P12. Longitudinal holding frame N17 is moved towards front side board H12 by the force of spring N20. As a result, any displaced bank notes are moved towards the front side board H12 and are forced to be arrayed together in a stack.

Next, bank note holder H is moved into storing section 6 along guide rail 11 and 12. During this process, end H47 of hook H42 has contact with pusher 10, and hook H42 pivots, and hook H42 disengages from pin H46 (as shown in FIG. 5). Therefore width holder frame H16 is moved towards the right side board H11 by spring H29. Afterwards, the width holder frame H16 is moved forcibly by the link device L and the width holder frame H16 is continually biased by the spring H29 to exert a predetermined force on the stack of bank notes.

Bank notes which are not lined up in the width direction are therefor moved towards to the right side board H11 by the force of spring H29 and are primarily arrayed. Next, pin L14 has contact with cam surface R17 of cam R13. Therefore, pin L14 is moved towards the right at FIG. 5. Lever 11 is now pivoted in the clockwise direction.

Pin L13 is moved towards the left by lever L11 as shown in FIG. 5. Vertical board H15 is moved towards the right side board H11. As a result, the bank notes which are not lined up in the width direction are moved towards the right side board H11, and are secondarily arrayed.

During this process, when vertical board H15 doesn't move towards the right side board H11, cam board R13 is moved by pin L14, because the force of spring R16 is small. Afterwards pin L14 has contact with straight section R20 of cam R13 and the position is maintained.

Before bank note holder H moves into the predetermined position, pin K16 pushes slanting surface K18 of lever K11. Therefore, lever K11 pivots in the clockwise direction as shown in FIG. 6. When bank note holder H is moved to a predetermined position, pin K16 disengages from slanting surface K18 and is hooked by hook K15. As a result, bank note holder H is locked in the bank note storing device 1 by lock device K.

Next, lid 3 is closed and is locked by lock 4. Therefore, projection P16 is located near projection P14 and lever P11 is kept at the release position. As a result, the re-supply of bank note storing device 1 is finished. Afterwards, bank note storing device 1 is put into vending machines, etc.

In this specification, "horizontal" and "vertical" are conveniently used to define relative positions but should not be interpreted as limiting to the scope of the present invention. Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An automatic adjusting device to accommodate different size bank notes that can be stored for dispensing comprising:

a bank note holder that can be positioned in a safe having a support member with a first side wall, a second side wall, a first end wall, and a second end wall extending upward from the support member;

a first biasing member to bias the first side wall and the second side wall towards each other;

a second biasing member to bias the first end wall and the second end wall towards each other; and a mechanical unit for extending the respective first side wall and second side walls apart and extending the first end wall and the second end wall apart when the bank note holder is removed from the safe, and contracting the respective first side wall and second side wall together and contracting the respective first end wall and second end wall together when the bank note holder is inserted in the safe.

2. The automatic adjusting device of claim 1, wherein the mechanical unit further includes means for holding the position of the respective positions of the first side wall, the second side wall, the first end wall, and the second end wall in the extended position when the bank note holder is removed from the safe.

3. The automatic adjusting device of claim 2, wherein the means for holding includes pivoting hook members for capturing pin members.

4. The automatic adjusting device of claim 1, wherein the mechanical unit includes a width holder frame which can be moved to accommodate the width of a bank note in the bank note holder; a link device which is operatively linked to the width holder frame; and an operating device which is located on the bank note storing device and is operatively linked to the link device wherein the width holder frame is moved to an open position for receiving bank notes when the link device is activated upon removal of the bank note holder from the bank note storing device.

5. The automatic adjusting device of claim 1, wherein the mechanical unit includes a width holder frame biased by the first biasing member to reduce the width displacement of bank notes in the bank note holder; a width holder which holds the width holder frame at a position that is wider than a bank note width; a releasing device which releases the width holder when the bank note holder is moved into the bank note storing device; a link device which is operatively linked to the width holder frame; and an operating device which is located on a bank note storing device and is operatively linked to the link device, wherein the width holder frame is moved to an open position for receiving bank notes when the link device is activated.

* * * * *